US008225452B2

(12) United States Patent
Fischer

(10) Patent No.: US 8,225,452 B2
(45) Date of Patent: Jul. 24, 2012

(54) MOPPING DEVICE WITH TWO MOPPING WINGS WHICH CAN BE FOLDED TOGETHER

(75) Inventor: Klaus-Juergen Fischer, Holzappel (DE)

(73) Assignee: Leifheit AG, Nassau/Lahn (DE)

( * ) Notice: Subject to any disclaimer, the term of this patent is extended or adjusted under 35 U.S.C. 154(b) by 748 days.

(21) Appl. No.: 12/295,529

(22) PCT Filed: Apr. 10, 2007

(86) PCT No.: PCT/EP2007/003167

§ 371 (c)(1),
(2), (4) Date: Sep. 30, 2008

(87) PCT Pub. No.: WO2007/118633

PCT Pub. Date: Oct. 25, 2007

(65) Prior Publication Data

US 2009/0044358 A1 Feb. 19, 2009

(30) Foreign Application Priority Data

Apr. 13, 2006 (DE) ..... 10 2006 017 426

(51) Int. Cl.
*A47L 13/146* (2006.01)

(52) U.S. Cl. ..... 15/119.2; 15/244.2; 15/228

(58) Field of Classification Search ..... 15/119.1, 15/119.2, 116.1, 116.2, 228, 244.1, 244.2
See application file for complete search history.

(56) References Cited

U.S. PATENT DOCUMENTS

| | | | | |
|---|---|---|---|---|
| 3,224,025 | A | 12/1965 | Altrock et al. | |
| 4,044,419 | A | 8/1977 | Robinson et al. | |
| 6,675,426 | B2 * | 1/2004 | Ohm et al. | 15/119.2 |
| 6,675,462 | B1 | 1/2004 | Takahashi et al. | |
| 6,854,150 | B2 * | 2/2005 | Hirse | 15/119.2 |
| 7,469,441 | B2 * | 12/2008 | Hirse | 15/119.2 |
| 2006/0137121 | A1 * | 6/2006 | Niccolai | 15/119.2 |

FOREIGN PATENT DOCUMENTS

| | | |
|---|---|---|
| DE | 10058630 | 7/2002 |
| EP | 1188406 | 3/2002 |
| EP | 1208788 | 5/2002 |
| WO | 2004054424 | 7/2004 |

OTHER PUBLICATIONS

International Search Report, Application No. PCT/EP2007/003167, dated Jul. 26, 2007.

* cited by examiner

*Primary Examiner* — Dung Van Nguyen
(74) *Attorney, Agent, or Firm* — Leydig, Voit & Mayer, Ltd.

(57) ABSTRACT

A mopping device includes a mop plate including a first mopping wing and a second mopping wing. The first and second mopping wings are configured to fold toward one another, and the first and second mopping wings each include a first material and each include at least one sliding element made of a second material. The mopping device further includes a first squeezing arm and a second squeezing arm disposed movably relative to the first and second mopping wings. The first and second squeezing arms are configured to respectively slide on the respective at least one sliding element and fold the first and second mopping wings toward one another.

11 Claims, 1 Drawing Sheet

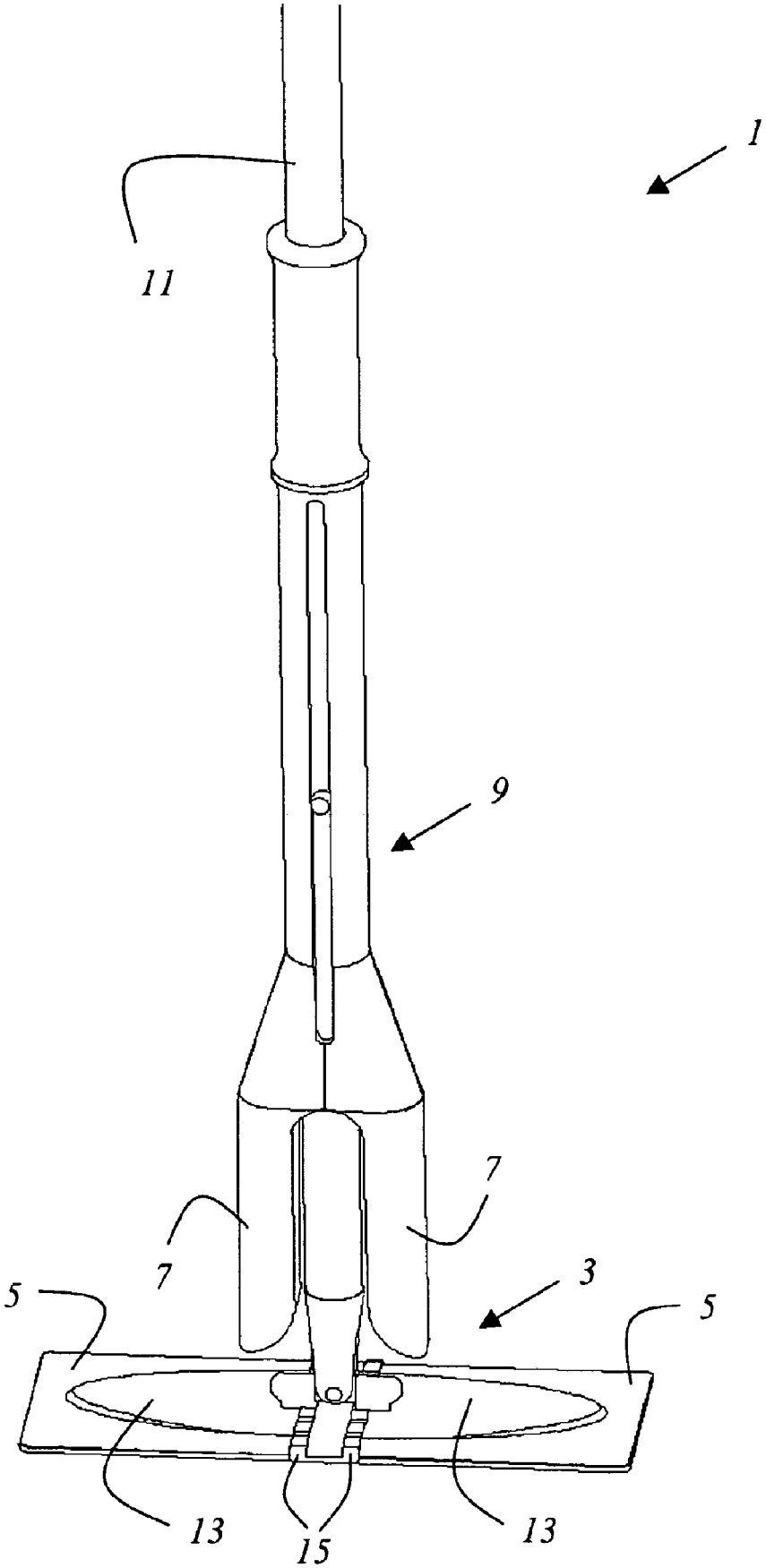
1
11
9
7
7
3
5
5
13
15
13

MOPPING DEVICE WITH TWO MOPPING WINGS WHICH CAN BE FOLDED TOGETHER

CROSS-REFERENCE TO PRIOR APPLICATIONS

This application is a U.S. National Phase application under 35 U.S.C. §371 of International Application No. PCT/EP2007/003167, filed Apr. 10, 2007, and claims benefit to German Patent Application No. DE 10 2006 017 426.7, filed Apr. 13, 2006. The International Application was published in German on Oct. 25, 2007 as WO 2007/118633 under PCT Article 21 (2).

FIELD

The present invention relates to a mopping device having a mop plate that includes two mopping wings, foldable toward one another, made of a first material; and having squeezing arms, arranged movably relative to the mopping wings, for folding the mopping wings toward one another.

BACKGROUND

DE 100 58 630 C1 describes a floor mop having two carrier plates joined in articulated fashion to a common center piece. The carrier plates carry an absorbent mopping cover and are engageable, via a complex roller design, with a squeezing-out slider that includes two rigid squeezing-out arms, in order to fold the carrier plates together and thereby squeeze out and dry them.

U.S. Pat. No. 3,224,025 also describes a mopping device having a complex roller design for folding the mop plates together with the aid of a squeezing fork.

EP 1 208 788 A1 describes a wet mop for planar surfaces having two mopping plates connected with interposition of a double joint and pressable toward one another. The wet mop includes a swingable handle mounted on the double joint. A sliding sleeve, arranged on the handle and having two pressure arms that are slidable over the mopping wings, is provided for pressing the mopping plates toward one another.

SUMMARY

An aspect of the present invention is to provide a mopping device that enables easier squeezing-out of the mopping cover with little manufacturing complexity.

In an embodiment, the present invention provides a mopping device including a mop plate including a first mopping wing and a second mopping wing. The first and second mopping wings are configured to fold toward one another, and the first and second mopping wings each include a first material and each include at least one sliding element made of a second material. The mopping device further includes a first squeezing arm and a second squeezing arm disposed movably relative to the first and second mopping wings. The first and second squeezing arms are configured to respectively slide on the respective at least one sliding element and fold the first and second mopping wings toward one another.

BRIEF DESCRIPTION OF THE DRAWINGS

The present invention will be elaborated upon below based on an exemplary embodiment with reference to the drawing. Identically functioning elements being labeled with the same reference characters. In the Figures:

FIG. 1 shows a mopping device in an embodiment according to the present invention.

DETAILED DESCRIPTION

In an embodiment, the present invention provides a mopping device which is characterized in that each mopping wing includes at least one sliding element, made of a second material, on which the squeezing arms slide.

It has been recognized according to the present invention that friction between the squeezing arms and the mopping wings is a factor in terms of the energy expenditure for squeezing out a mopping cover. Generally, a reduction in friction could be avoided by using roller designs. This results, however, in a considerable increase in complexity during manufacture of the mopping device.

To allow a satisfactory cleaning result to be obtained in particular on uneven surfaces, in particular floors, the mopping wings are preferably be made of a material of sufficient flexibility that the mopping wings can adapt to the floor shape. It is therefore difficult to replace the flexible (and therefore friction-susceptible) material of the mopping wings with a material having good sliding properties.

According to an embodiment of the present invention, not only is the adaptability of the mopping wings to uneven surfaces retained, but easier pressing of the mopping wings toward one another is also simultaneously achieved, by reducing the friction between the squeezing arms and the mopping wings.

In accordance therewith, the first material, from which the mopping wings are manufactured, is softer and/or more flexible than the second material, from which the sliding elements are manufactured. In particular, in an embodiment of the mopping device according to the present invention, the second material is smoother than the first material.

In an embodiment according to the present invention, the second material is a plastic, by preference polytetrafluoroethylene (PTFE).

In another embodiment according to the present invention, the second material is a metal.

In another embodiment of the mopping device according to the present invention, the sliding elements are adhesively bonded on or screwed on. In another embodiment according to the present invention that can be manufactured efficiently, the sliding elements are manufactured together with the mopping wings in a two-component injection molding process.

In another embodiment according to the present invention, the mopping wings include gripping hooks for securing a mopping cover. It is preferable to manufacture the gripping hooks together with the mopping wings in one piece, for example using an injection molding method. Further, because the mopping wings are made of a flexible material, the gripping hooks manufactured together therewith are also sufficiently flexible to participate in a secure bond with the gripping strip of the mopping cover.

The mopping device according to the present invention can be embodied, for example, as a flat mop and/or as a floor mop and/or as a window mop and/or as a furniture mop.

In an embodiment according to the present invention, the squeezing arms are parts of a squeezing fork. Provision can be made that the squeezing fork and/or the squeezing arms are arranged displaceably along a handle in guided fashion.

In another embodiment according to the present invention, the squeezing fork is slidable over the plate wings, preferably in guided fashion, for example guided on a handle.

Provision can be made that the handle is connected to the mop plate in articulated fashion, for example in the fashion of a gimbal or a universal joint.

As an alternative to a squeezing fork provision can also be made, for example, to use for folding the first and second plate wings toward one another a preferably funnel-shaped or V-shaped squeezing sieve which the foldable mop plate is introduced.

FIG. 1 shows a mopping device 1 according to the present invention, having a mop plate 3 that includes two mopping wings 5, foldable toward one another, made of a first material. Mopping device 1 is equipped with two squeezing arms 7 arranged movably relative to mopping wings 5. Squeezing arms 7 are part of a squeezing fork 9 that is arranged displaceably along a handle 11. Each of mopping wings 5 has a respective sliding element 13 made of a second material. Mopping wings 5 are furthermore equipped with gripping hooks for securing a mopping cover. By pushing squeezing fork 9 having squeezing arms 7 over mop plate 3, mopping wings 5 are respectively folded rotatingly onto one another in joints 15, and the mopping cover is thereby squeezed out and dried. In this operation, squeezing arms 7 slide on sliding elements 13, which are manufactured from a slidable material, namely polytetrafluoroethylene (PTFE). The first material, from which plate wings 5 are manufactured, is softer and more flexible than the second material, so that a good gripping connection can also be made—because the gripping hooks are not too hard and inflexible—between the mopping cover and plate wings 5.

The invention has been described with reference to a particular exemplifying embodiment. It is self-evident, however, that changes and modifications can be made without thereby leaving the range of protection of the claims below. Accordingly, the present invention is not limited to the embodiments described herein; reference should be had to the appended claims.

The invention claimed is:

1. A mopping device comprising:

a mop plate including a first mopping wing and a second mopping wing, the first and second mopping wings being configured to fold toward one another, the first and second mopping wings each including a first material and each including at least one respective sliding element made of a second material, wherein the first and the second materials are different materials; and a first squeezing arm and a second squeezing arm disposed movably relative to the first and second mopping wings, the first and second squeezing arms being configured to respectively slide on the at least one respective sliding element and configured to fold the first and second mopping wings toward one another;

wherein the second material is a plastic, wherein the plastic includes at least one of a polytetrafluoroethylene (PTFE), a polyvinylidene fluoride (PVDF), a polyacetal (POM), and an acrylonitrile-butadiene-styrene copolymer (ABS).

2. The mopping device as recited in claim 1, wherein the first and second squeezing arms are part of a squeezing fork.

3. The mopping device as recited in claim 2, wherein the squeezing fork is disposed displaceably on a handle.

4. The mopping device as recited in claim 1, wherein the first and second squeezing arms are disposed displaceable on a handle.

5. The mopping device as recited in claim 1, wherein a softness of the first material is greater than a softness of the second material.

6. The mopping device as recited in claim 1, wherein a flexibility of the first material is greater than a flexibility of the second material.

7. The mopping device as recited in claim 1, wherein a smoothness of the first material is greater than a smoothness of the second material.

8. The mopping device as recited in claim 1, wherein the at least one respective sliding element is coupled to the respective first and second mopping wings via adhesive bonding.

9. The mopping device as recited in claim 1, wherein the at least one respective sliding element is coupled to the respective first and second mopping wings via a screw coupling.

10. The mopping device as recited in claim 1, wherein the at least one respective sliding element is manufactured together with the respective first and second mopping wings in a two-component injection molding process.

11. The mopping device as recited in claim 1, wherein the mopping device is at least one of a flat mop, a floor mop, a window mop, and a furniture mop.

* * * * *